US006662518B1

(12) United States Patent
Devereux

(10) Patent No.: US 6,662,518 B1
(45) Date of Patent: Dec. 16, 2003

(54) FLOOR COVERING TRANSITION DEVICE

(75) Inventor: Paul H. Devereux, Dallas, TX (US)

(73) Assignee: Arbor Contract Carpet, Inc., Irving, TX (US)

( * ) Notice: Subject to any disclaimer, the term of this patent is extended or adjusted under 35 U.S.C. 154(b) by 0 days.

(21) Appl. No.: 10/202,231

(22) Filed: Jul. 24, 2002

(51) Int. Cl.[7] ..... F04C 2/38

(52) U.S. Cl. ..... 52/716.1; 52/395; 52/393; 52/403.1; 52/396.04; 52/459; 52/461; 52/465; 52/466; 52/469; 52/717.04; 52/717.05; 52/273; 16/4; 16/7; 16/8; 16/16; 49/467; 49/469; 49/470; 49/471; 49/478

(58) Field of Search ..... 52/384, 716.1, 52/385, 386, 387, 395, 393, 403.1, 459, 461, 465, 466, 469, 717.04, 396.04, 717.03, 707.05, 273; 16/16, 4, 7, 8; 49/467, 469, 470, 471, 478

(56) References Cited

U.S. PATENT DOCUMENTS

| | | | | | |
|---|---|---|---|---|---|
| 1,966,020 | A | * | 7/1934 | Rowley | 16/7 |
| 2,051,191 | A | * | 8/1936 | Watson | 16/16 |
| 2,142,782 | A | * | 1/1939 | Gillette | 411/474 |
| 2,554,674 | A | * | 5/1951 | Karas | 16/16 |
| 2,677,145 | A | * | 5/1954 | Adams | 16/16 |
| 2,926,378 | A | * | 3/1960 | Eichhorn et al. | 16/4 |
| 2,980,943 | A | * | 4/1961 | Barnes et al. | 16/7 |
| 2,994,905 | A | * | 8/1961 | Franker, Jr. | 52/273 |
| 3,254,361 | A | * | 6/1966 | Brunn et al. | 16/16 |
| 3,413,678 | A | * | 12/1968 | Krantz | 16/16 |
| 3,528,122 | A | * | 9/1970 | Fuller et al. | 16/16 |
| 3,603,048 | A | * | 9/1971 | Hadfield et al. | 52/220.1 |
| 3,607,360 | A | * | 9/1971 | Elmer | 427/393.5 |
| 3,736,713 | A | * | 6/1973 | Flachbarth et al. | 52/220.1 |
| 3,862,874 | A | * | 1/1975 | Hopper et al. | 428/47 |
| 3,889,320 | A | * | 6/1975 | Koscik | 24/297 |
| 3,961,118 | A | | 6/1976 | Michaelis | 428/151 |
| 4,067,155 | A | * | 1/1978 | Ruff et al. | 52/105 |
| 4,069,542 | A | * | 1/1978 | Carder | 16/16 |
| 4,089,140 | A | * | 5/1978 | McIntyre et al. | 52/98 |
| 4,268,566 | A | * | 5/1981 | Ebert | 428/195 |
| 4,413,446 | A | | 11/1983 | Dittrich | 49/470 |
| 4,416,713 | A | * | 11/1983 | Brooks | 156/64 |
| 4,581,269 | A | * | 4/1986 | Tilman | 428/62 |
| 4,653,138 | A | * | 3/1987 | Carder | 16/4 |
| 4,810,546 | A | * | 3/1989 | McLaughlin | 428/62 |
| 4,837,889 | A | * | 6/1989 | Saotome | 16/4 |
| 4,945,680 | A | | 8/1990 | Giguere | 49/468 |
| 4,970,754 | A | | 11/1990 | Anderson et al. | 16/16 |
| 5,198,300 | A | * | 3/1993 | Matthews et al. | 428/354 |
| 5,581,967 | A | | 12/1996 | Glatz | 52/465 |
| 5,642,568 | A | | 7/1997 | Lapka | 33/526 |
| 5,661,874 | A | * | 9/1997 | Latour | 16/4 |
| 5,756,176 | A | | 5/1998 | Feld | 428/48 |
| 5,766,726 | A | * | 6/1998 | Bannister | 428/119 |

(List continued on next page.)

OTHER PUBLICATIONS

"How to Install Carpet," truevalue.com website.
"How to install wall–to–wall carpet," internet reference site.

*Primary Examiner*—Carl D. Friedman
*Assistant Examiner*—Christy Green
(74) *Attorney, Agent, or Firm*—Gardere Wynne Sewell LLP

(57) ABSTRACT

The present invention provides a device for transitioning between a first floor covering and a second floor covering wherein the transition device includes an elongated core and a covering. The elongated core has a top, a bottom, opposing sides and opposing ends. The covering is attached to the elongated core and covers the top and opposing sides of the elongated core. The present invention also provides method for manufacturing the transition device. In addition, the present invention provides a system having an elongated core and a covering as described above. A first floor covering is attached to the floor and abuts one side of the transition device. Similarly, a second floor covering is attached to the floor and abuts the other side of the transition device.

42 Claims, 5 Drawing Sheets

U.S. PATENT DOCUMENTS

| | | | | | |
|---|---|---|---|---|---|
| 5,976,290 | A | | 11/1999 | MacDonald et al. | 156/92 |
| 6,038,733 | A | * | 3/2000 | Carder et al. | 16/16 |
| 6,062,517 | A | * | 5/2000 | Torres et al. | 248/188.2 |
| 6,125,599 | A | | 10/2000 | Mees et al. | 52/204.5 |
| 6,138,323 | A | * | 10/2000 | Thøgersen | 16/16 |
| 6,141,931 | A | | 11/2000 | Simmons | 52/480 |
| 6,247,285 | B1 | | 6/2001 | Moebus | 52/589.1 |
| 6,295,763 | B1 | | 10/2001 | Serba | 49/468 |
| 6,340,264 | B1 | * | 1/2002 | Nelson | 403/297 |
| 6,412,227 | B1 | | 7/2002 | De Zen | 49/504 |

* cited by examiner

FLOOR COVERING TRANSITION DEVICE

TECHNICAL FIELD OF THE INVENTION

The present invention relates generally to the field of wall to wall carpeting techniques, and more particularly to floor covering transition device for use between a section of carpet and another floor covering.

BACKGROUND OF THE INVENTION

Carpet installation and replacement in dwellings, such as homes and apartment units can be a very expensive proposition. This is primarily due to the fact that adjoining pieces of carpet within a room or between rooms must match. In other words, all the pieces of carpet must come from the same dye lot. Otherwise, a person will be able to visually detect that the pieces of carpet do not match. This problem drastically increases the cost of carpet replacement because all the carpet has to be replaced rather than only those pieces or rooms that need new carpet. One attempt to solve this problem has been the replacement of a section of carpet with a wood floor looking laminate product (or sheet vinyl). For example, the carpet in a hallway is replaced with the wood floor locking laminate product. As a result, the carpet in the rooms adjoining the hallway, such as bedrooms, does not have to match each other. The biggest drawback of this type of installation is that it is substantially more expensive than a conventional installation. Moreover, this approach also does not allow the possibility of installing carpet in a living room and dining room independent of one another.

There is, therefore, a need for a transition device that can be installed between two floor coverings to separate areas and allow the use of different carpet dye lots.

SUMMARY OF THE INVENTION

The present invention provides a transition device that can be installed between two pieces of flooring material or floor covering to separate areas, such as rooms, closets and hallways, in a typical dwelling. The present invention is particularly applicable for use in apartment units to provide eye-appealing, fashionable accents to the finished appearance of the apartment unit. By separating the different rooms and isolatable floor areas, different dye-lots and even different colors can be combined in the same unit, a practice that has never been possible previously. The ability to mix colors and dye-lots allows the installer to use a much lower priced segment of the carpet mills inventory stock known as "short-rolls" or remnants. Typically, this carpet was difficult for the mills to get rid of and is priced at less than half the normal cost of full rolls of carpet.

The finished initial installation also gives the management companies the option of replacing partial units or isolated rooms or areas in an apartment unit. This has been impractical previous to the development of the present invention due to the fact that carpeting is manufactured in dye lot increments and generally carpets that come from different dye lots cannot be combined. Consequently, if a single room needs to be replaced in a unit, normally replacement of the carpet within the entire unit is ordered so that all the carpet will match. As a result, management companies are able to save money and time as compared to a conventional carpet installation. This is possible due to the fact that the present invention allows the use of short rolls and remnants for these installations, which can be bought at significant discounts from standard carpet at full-roll pricing. Moreover, the transition devices of the present invention provide a new visual appearance for apartment units in a business where there is very little opportunity to differentiate product, namely the unoccupied apartment unit that is being marketed. The apartment units all look very much the same, especially when it comes to the flooring products.

More specifically, the present invention provides a device for transitioning between a first floor covering and a second floor covering wherein the transition device includes an elongated core and a covering. The elongated core has a top, a bottom, opposing sides and opposing ends. The covering is attached to the elongated core and covers the top and opposing sides of the elongated core.

The present invention also provides a system having a transition device attached to a floor that has an elongated core and a covering. The elongated core has a top, a bottom, opposing sides and opposing ends. The covering is attached to the elongated core and covers the top and opposing sides of the elongated core. A first floor covering is attached to the floor and abuts one side of the transition device. Similarly, a second floor covering is attached to the floor and abuts the other side of the transition device.

In addition, the present invention provides a method for manufacturing a device for transitioning between a first floor covering and a second floor covering. An elongated core is fabricated having a top, a bottom, opposing sides and opposing ends. A covering is then attached to the elongated core such that the covering covers the top and opposing sides of the elongated core.

Other features and advantages of the present invention will be apparent to those of ordinary skill in the art upon reference to the following detailed description taken in conjunction with the accompanying drawings.

BRIEF DESCRIPTION OF THE DRAWINGS

For a better understanding of the invention, and to show by way of example how the same may be carried into effect, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not limit the scope of the invention.

The present invention provides a transition device that can be installed between two pieces of flooring material or floor covering to separate areas, such as rooms, closets and hallways, in a typical dwelling. The present invention is particularly applicable for use in apartment units to provide eye-appealing, fashionable accents to the finished appearance of the apartment unit. By separating the different rooms and isolatable floor areas, different dye-lots and even different colors can be combined in the same unit, a practice that has never been possible previously. The ability to mix colors and dye-lots allows the installer to use a much lower priced segment of the carpet mills inventory stock known as "short-rolls" or remnants. Typically, this carpet was difficult for the mills to get rid of and is priced at less than half the normal cost of full rolls of carpet.

The finished initial installation also gives the management companies the option of replacing partial units or isolated rooms or areas in an apartment unit. This has been impractical previous to the development of the present invention due to the fact that carpeting is manufactured in dye lot increments and generally carpets that come from different dye lots cannot be combined. Consequently, if a single room needs to be replaced in a unit, normally replacement of the carpet within the entire unit is ordered so that all the carpet will match. As a result, management companies are able to save money and time as compared to a conventional carpet installation. This is possible due to the fact that the present invention allows the use of short rolls and remnants for these installations, which can be bought at significant discounts from standard carpet at full-roll pricing. Moreover, the transition devices of the present invention provide a new visual appearance for apartment units in a business where there is very little opportunity to differentiate product, namely the unoccupied apartment unit that is being marketed. The apartment units all look very much the same, especially when it comes to the flooring products.

Figure 1A:
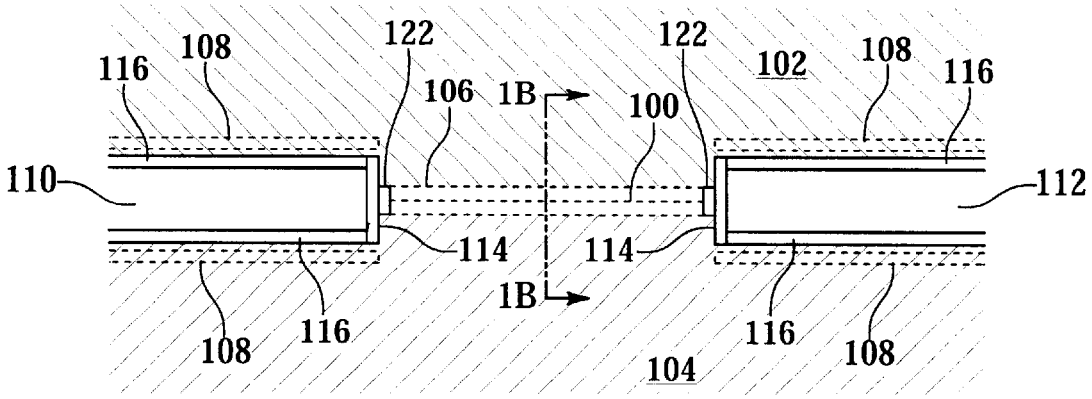
Fig.1A (PRIOR ART)
FIG. 1A illustrates a transition between two floor coverings in a doorway in accordance with the prior art.

For example, FIG. 1A illustrates a transition 100 between two floor coverings 102 (first floor covering) and 104 (second floor covering) in a doorway in accordance with the prior art. The doorway includes a doorframe 114, which has a doorstop 122, located between walls 110 and 112. Molding 116 is installed at the base of wall 110 and 112 around the perimeter of the rooms. Carpet in the different rooms and hallways, such as 102 and 104 are seamed together with hot seaming tape 106. The glue on the tape 106 is activated by an electric seaming iron, which is run across the tape 106. Both pieces of carpet 102 and 104 are set together across the seaming tape 106, pushed together tightly and left to bond as the glue hardens (as it cools). The carpet 102 and 104 in the rooms is secured to the floor by stretching it over tack strips 108, which are installed around the perimeter of the rooms. The tack strips 108 are typically strips of wood or synthetic material about ¼inch thick, 1 inch wide and 3 feet long that have metal pins embedded in them. The pins stick up out of the wood about ⅛of an inch and hold the carpet in place after the carpet is stretched over it. Tackless strips may also be used.

Seaming the two pieces of carpet together 102 and 104 is a labor intensive and "tricky" proposition. More specifically, two pieces of carpet 102 and 104 are seamed together by overlapping the edges of the carpet 102 and 104 leaving about 2 inches of excess carpet at the middle of the doorway. A chalk line is then snapped on the back of the overlapped carpet edges and a straight edge is trimmed to ensure a straight seam. The straight edges are overlapped and a row cutter is used to cut the bottom piece. The edge of the top piece is used as a guide in cutting the seam to fit. A length of seaming tape 106 is cut and centered under the seam. The adhesive side of the tape 106 must be facing up and the carpet seams must butt up against each other. A seaming iron is then used to melt the adhesive by slowly pulling the iron down the tape 106. Once the adhesive is melted, the carpet edges are immediately pressed together over the tape 106. The seam should then be rolled over with a seam rolling tool.

Figure 1B:
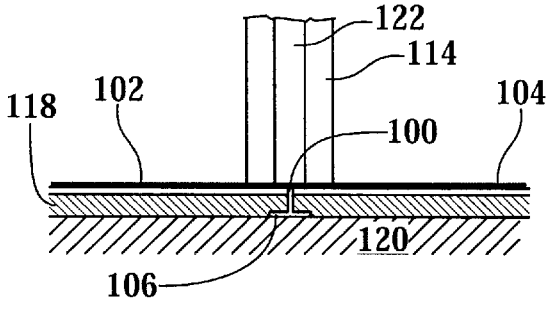
Fig.1B (PRIOR ART)
FIG. 1B is a cross sectional view of FIG. 1A.

Now referring to FIG. 1B, a cross sectional view of FIG. 1A is shown. First floor covering 102 and second floor covering 104, both of which are carpet in this example, are installed on padding 118, which is placed on top of the floor 120. The seam or transition 100 is located between the doorframes 114 and is created, as described above, using seaming tape 106.

Figure 2A:
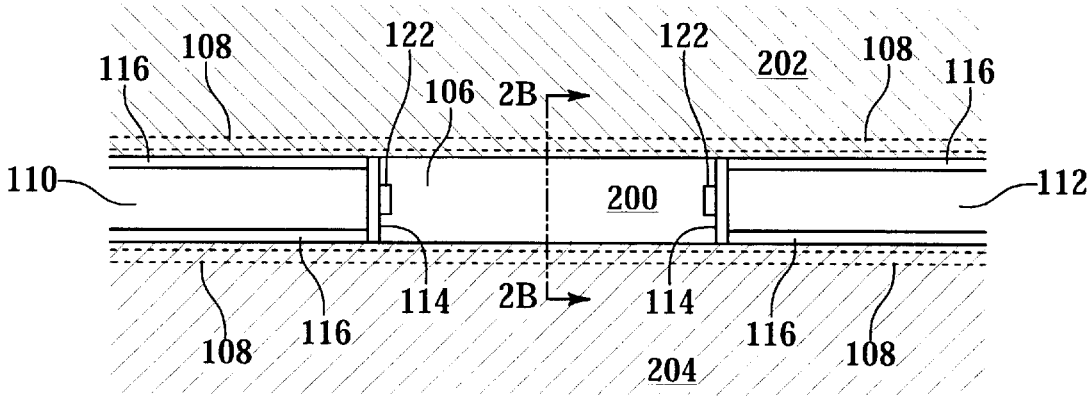
FIG. 2A illustrates a transition device between two floor coverings in a doorway in accordance with the present invention.

Referring now to the present invention as illustrated in FIG. 2A, a transition device 200 between two floor coverings 202 (first floor covering) and 204 (second floor covering) in a doorway in accordance with the present invention is shown. The doorway includes a doorframe 114, which has a doorstop 122, located between walls 110 and 112. Molding 116 is installed at the base of wall 110 and 112 around the perimeter of the rooms. The carpet 202 and 204 in the rooms is secured to the floor by stretching it over tack strips 108, which are installed around the perimeter of the rooms. As previously described, the tack strips 108 are typically strips of wood or synthetic material about ¼inch thick, 1 inch wide and 3 feet long that have metal pins embedded in them. The pins stick up out of the wood about ⅛of an inch and hold the carpet in place after the carpet is stretched over it. Tackless strips may also be used. The edges of carpet 202 and 204 are pushed between the wall and the tack strips 108 and the transition device 200 and the tack strips 108.

Transition devices 200, which may be simulated wood-plank insert pieces, are glued down throughout the entire unit after the old carpet is removed. Note that the transition devices 200 may also be used in new installations. The normal locations for the transition devices 200 are usually identical to those where regular seams go in a conventional installation. That would usually include all standard doors leading from one carpeted area to another and other strategic spots that create practical separation of carpets. These spots would include the beginning of a hallway leading to bedrooms and a prominent transition piece between the living room and dining room whenever possible. Note that the transition devices 200 can be used with other floor coverings, such as tile, wood or vinyl.

Figure 2B:
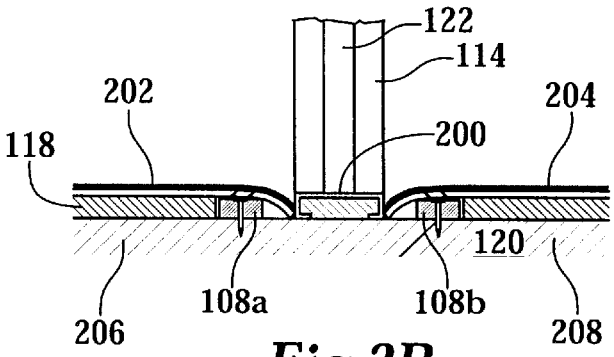
FIG. 2B is a cross sectional view of FIG. 2A.

Now referring to FIG. 2B, a cross sectional view of FIG. 2A is shown. Carpet 202 or the first floor covering is installed on padding 206 and carpet 204 or the second floor covering is installed on padding 208, both of which are placed on top of the floor 120. The transition device 200 is located between the doorframes 114 and between tack strips 108*a* and 108*b*. The transition device 200 is secured to the floor 120 with glue, masonry nails, screws or other fasteners. Note that the transition device 200 may include a notch in each end of the transition device 200 to accommodate the doorstop 122.

Figures 3A, 3B, 3C:
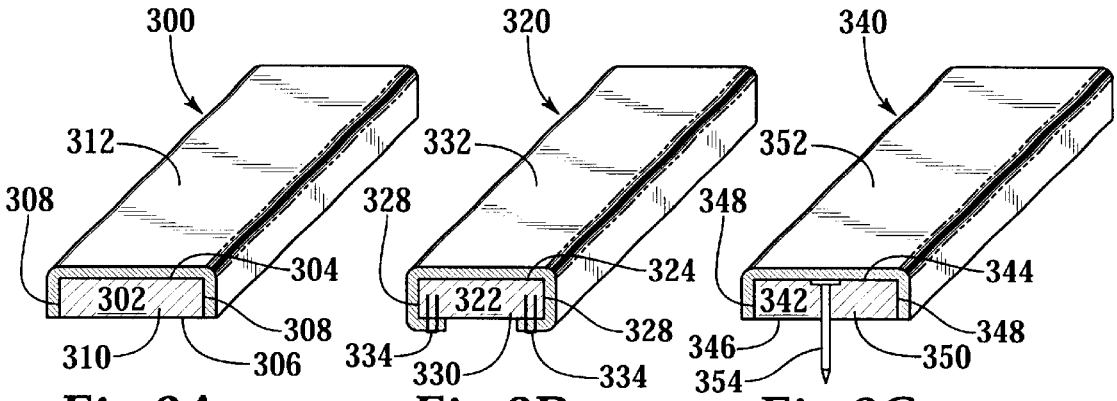
FIGS. 3A, 3B and 3C are isometric cross sectional views of a transition device in accordance with various embodiments of the present invention.

Referring now to FIGS. 3A, 3B and 3C, isometric cross sectional views of a transition device in accordance with various embodiments of the present invention are shown. FIG. 3A shows a transition device 300 having an elongated core 302 having a top 304, a bottom 306, opposing sides 308 and opposing ends 310, and a covering 312 attached to the elongated core 302 and covering the top 304 and opposing sides 308 of the elongated core 302. The covering 312 is preferably both decorative and wear-resistant. The covering 312 may be attached to the elongated core 302 using glue and/or staples, nails or screws so that there are no bubbles or slackness in the covering 312. The staples, nails or screws should be positioned so that the floor covering can hide them. The transition device 300 is typically secured to the floor using glue.

Similarly, FIG. 3B shows a transition device 320 having an elongated core 322 having a top 324, a bottom 326, opposing sides 328 and opposing ends 330, and a covering 332 attached to the elongated core 322 and covering the top 324, opposing sides 328 and portions of the bottom 326 of the elongated core 322. The covering 332 is preferably both decorative and wear-resistant. The covering 332 may be attached to the elongated core 302 using glue and/or staples 334, nails or screws so that there are no bubbles or slackness in the covering 332. The staples, nails or screws should be positioned so that the floor covering can hide them. The transition device 300 is typically secured to the floor using glue.

FIG. 3C also shows a transition device 340 having an elongated core 342 having a top 344, a bottom 346, opposing sides 348 and opposing ends 350, and a covering 352 attached to the elongated core 342 and covering the top 344 and opposing sides 348 of the elongated core 342. The covering 352 is preferably both decorative and wear-resistant. The covering 352 may be attached to the elongated core 342 using glue and/or staples, nails or screws so that there are no bubbles or slackness in the covering 352. The staples, nails or screws should be positioned so that the floor covering can hide them. The transition device 300 is secured to the floor using nails 354 and/or glue.

The elongated core 320, 322 and 342 can be made from wood, plywood, compressed fiberboard, pressboard, metal or other suitable material. The elongated core 320, 322 and 342 are typically ⅜" thick and either 5" wide or 7" wide depending on where they are installed. In addition, the edges between the top 304, 324 and 344 and the opposing sides 308, 328 and 348 of the elongated core 302, 322 and 342 can be square or rounded. Likewise, the elongated core's 302, 322 and 342 cross section can be substantially rectangular or trapezoidal.

The covering 312, 332 and 352 can be patterned vinyl, vinyl pieces, laminate, synthetic imitation material or other decorative and wear-resistant material. The covering 312, 332 and 352 is preferably at least 1/16 inch thick to provide durability. In the case of transition device 320, the covering 332 should extend at least ½ inch underneath the elongated core 322. For example, the covering 312, 332 and 352 can be made from the same durable sheet vinyl that typically goes into the kitchens and bathrooms of many standard apartment units. The wood plank styles of the sheet vinyl look surprisingly like real wood plank.

The transition devices 300, 320 and 340 330. that are to be used in doorways can be cut to the exact width of the door casings (universal standard sizes most often found are 24, 30 and 32 inches). The short side dimension of these transition devices 300, 320 and 340 330 is usually 5 inches. The transition devices 300, 320 and 340 330 that are used to separate living rooms from dining rooms usually have short side dimensions of 7 inches and are specially manufactured to whatever lengths are required. Special alterations can be easily made on site, as the material is easily cut with a small hand held saw.

The present invention allows installers to be issued the correct amount of the pre-manufactured transition devices 300, 320 and 340 when they pick up the carpet for the installation. Large inventories of the most common sized transition devices 300, 320 and 340 can be maintained at the carpet warehouse. For example, there are three common door sizes that occur more often than any others. A variety of other common sized transition devices 300, 320 and 340 that are used in non-door applications can also be stocked.

The transition device 300, 320 and 340 are also very inexpensive (under one dollar including labor) to manufacture. Moreover, installation of the transition devices 300, 320 and 340 is actually faster than seaming two pieces of carpet together.

Figures 3D, 3E:
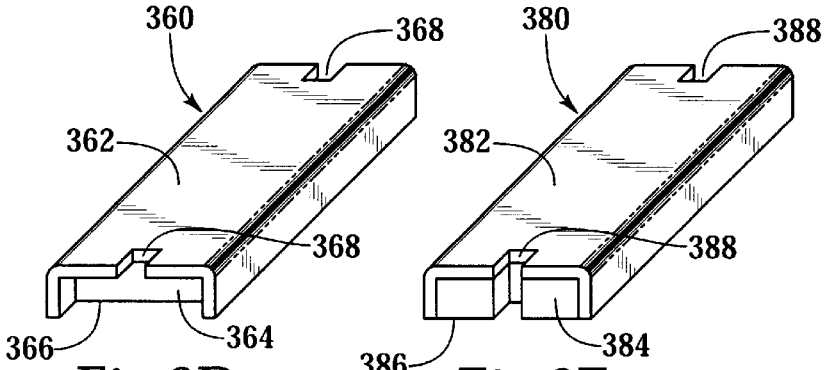
FIGS. 3D and 3E are isometric end views of a transition device in accordance with various embodiments of the present invention.

In door applications, the doorstop 122 (FIG. 1) of the doorframe or casing 114 (FIG. 1) can be accommodated in several ways as illustrated in FIGS. 3D and 3E, which are isometric end views of a transition device 360 and 380 in accordance with various embodiments of the present invention. In the transition device 360 shown in FIG. 3D, the covering 362 can be oversized such that it extends approximately one-half inch beyond the ends 364 of the elongated core 366. Notches 368 may then be precut or cut at the time of installation in the oversized covering 362 to accommodate the doorstop. In the transition device 380 shown in FIG. 3E, notches 388 may also be precut or cut at the time of installation in each end 384 of the covering 382 and the elongated core 386 to accommodate the doorstop. Alternatively, the bottom of the doorstop can be cut such that the transition device fits under the doorstop.

Figure 4:
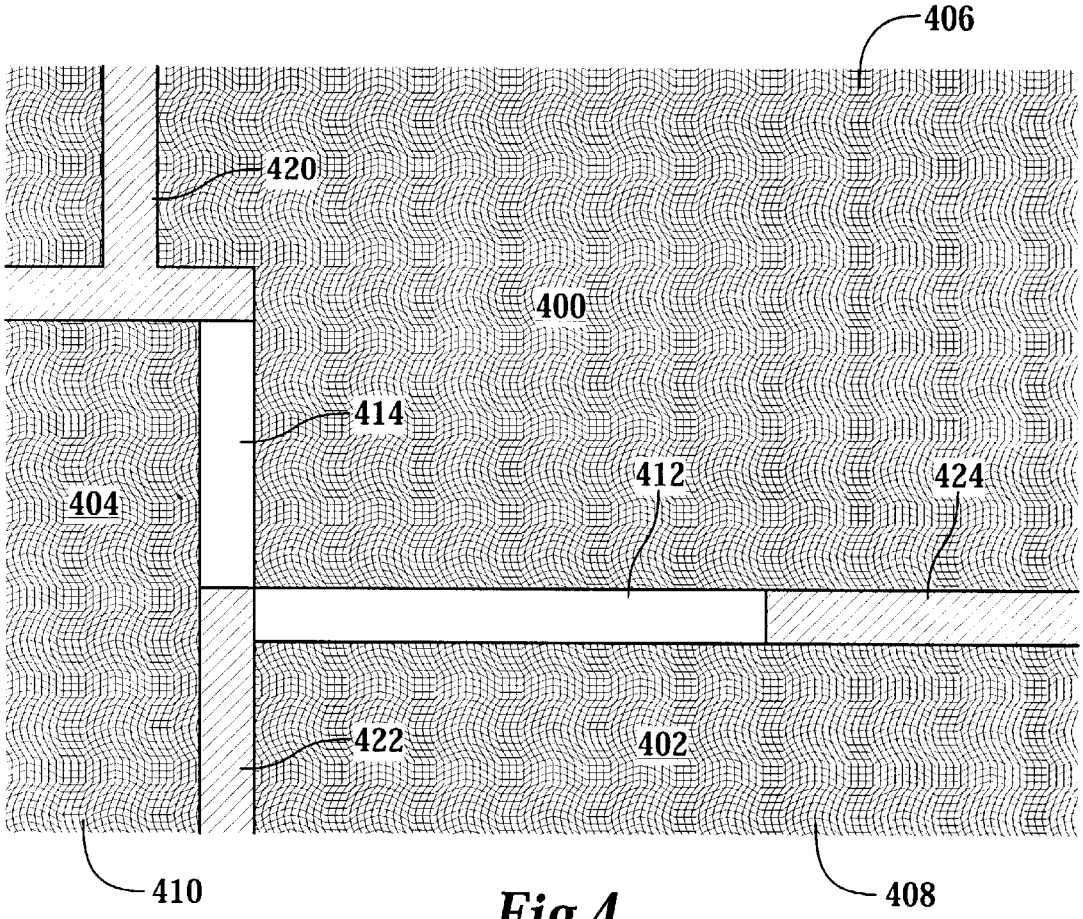
FIG. 4 illustrates the use of transition devices between rooms within a dwelling in accordance with one embodiment of the present invention.

Now referring to FIG. 4, the use of transition devices between rooms 400, 402 and 404 within a dwelling in accordance with one embodiment of the present invention is illustrated. Rooms 400, 402 and 404 are separated by walls 420, 422 and 424. Room 400 has a first floor covering 406, room 402 has a second floor covering 408 and room 404 has a third floor covering 410. Transition device 412 is installed in the opening between rooms 400 and 402, and provides a decorative and wear resistant transition between the first floor covering 406 and the second floor covering 408. Similarly, transition device 414 is installed in the doorway between rooms 400 and 404, and provides a decorative and wear resistant transition between the first floor covering 406 and the third floor covering 410. The first floor covering 406, second floor covering 408 and third floor covering 410 can be any combination of carpets, tile, wood or vinyl flooring.

The standard door transition devices are produced and installed so that they appear to be cut around the doorstop pieces. Slots are cut into the elongated core before the covering is attached so that the installer can easily cut to the shape of the doorstop piece at the job site. The width of the door jam pieces is 5 inches, which corresponds to the normal width of standard door jams. After installation, the transition device should appear as if it was custom fitted to the door jam it is secured to. As for the ⅜ inch thickness, this elevation from the floor that the transition devices is glued to provide an edge that tack strip can be installed along. Once the tack strip is down, the carpet in the room can be stretched over the pins and the resulting edge can be tucked into the slot between the tack-strip and the transition piece. The finished transition piece and the carpet on either side of it will end up creating a level surface with no dip or raised edge that could create a tripping hazard.

Figure 5:
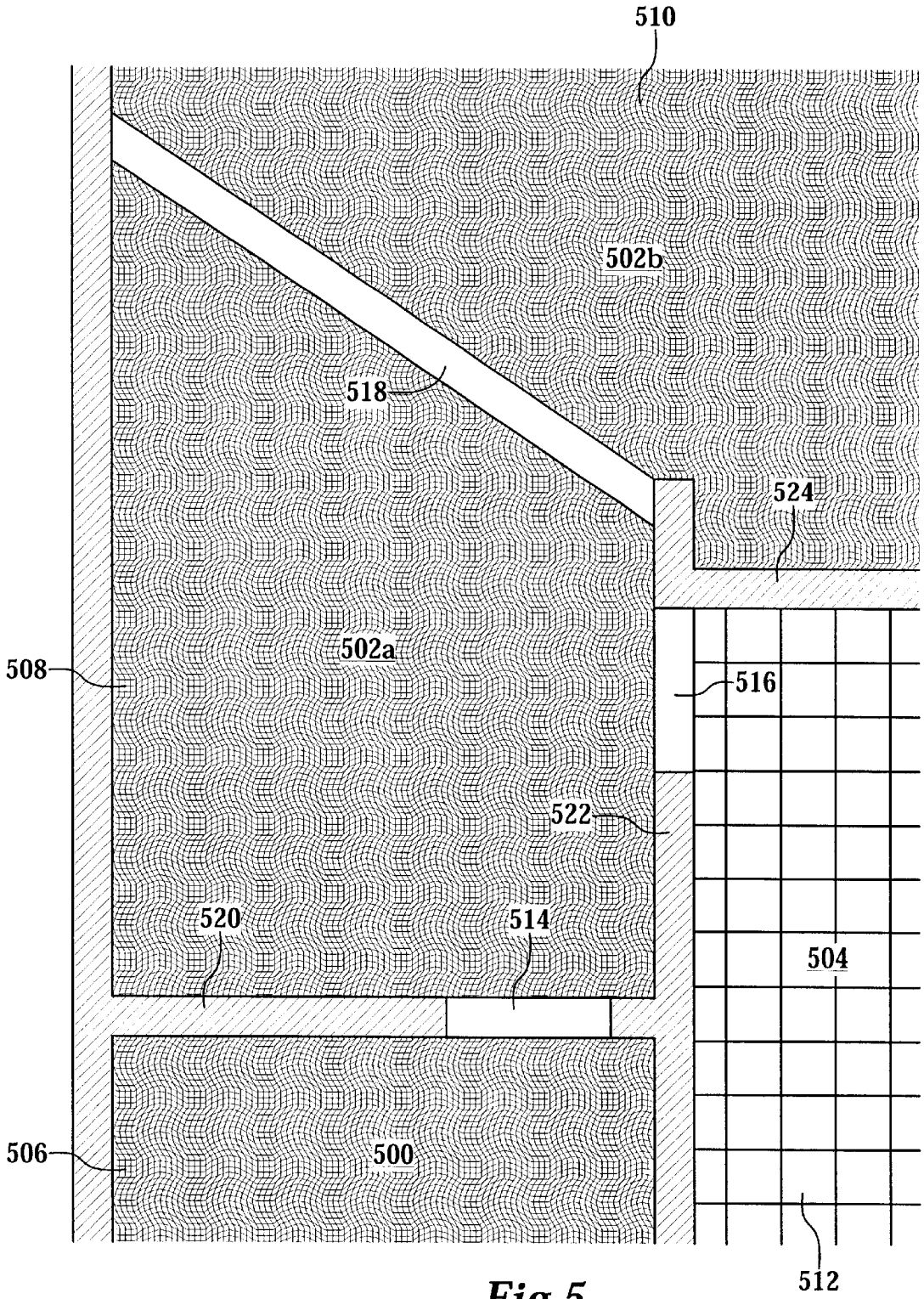
FIG. 5 illustrates the use of transition devices between rooms and within a roon within a dwelling in accordance with another embodiment of the present invention.

Referring now to FIG. 5, the use of transition devices between rooms and within a room within a dwelling in accordance with another embodiment of the present invention is illustrated. Rooms 500, 502*a*, 502*b* and 504 are separated by walls 520, 522 and 524. Room 500 has a first floor covering 506, room 502a has a second floor covering 508, room 502*b* has a third floor covering 510 and room 504 has a fourth floor covering 512. In this example, room 500 could be an entry hall, room 502*a* could be a dining room, room 502*b* could be a living room, and room 504 could be a kitchen. Transition device 514 is installed in the doorway between rooms 500 and 502*a*, and provides a decorative and wear resistant transition between the first floor covering 506 and the second floor covering 508. Similarly, transition device 516 is installed in the opening between rooms 500 and 504, and provides a decorative and wear resistant transition between the second floor covering 508 and the fourth floor covering 512. Transition device 516 is installed to separate room 502*a* and room 502*b*, and provides a decorative and wear resistant transition between the second floor covering 508 and the third floor covering 510. The first floor covering 506, second floor covering 508, third floor covering 510 and fourth floor covering can be any combination of carpets, tile, wood or vinyl flooring.

For example, living room/dining room transition pieces can be enhanced by creating "L" combinations or installing angled transition devices. The separation between the living room and dining room is where the most creativity can be used on the transition devices. These transition devices are usually in excess of 8 to 10 feet long and are preferably 7 inch wide if possible. Additionally, these transition devices are usually in close proximity to the kitchen. When a new kitchen floor is installed with the identical wood plank patterned sheet vinyl that is used to wrap the transition devices, the total effect is enhanced.

Non-doorway transition devices are normally cut to final size at the job site. When the transition device is not located at a conventional doorway, its width and length are determined by the opening it is being installed into. Normally 7 inch pieces are more dramatic, but the wall space that the transition device abuts to may not be sufficient to accept a full 7 inch piece. In that case, a 5 inch transition device would have to be used instead.

Figure 6A:
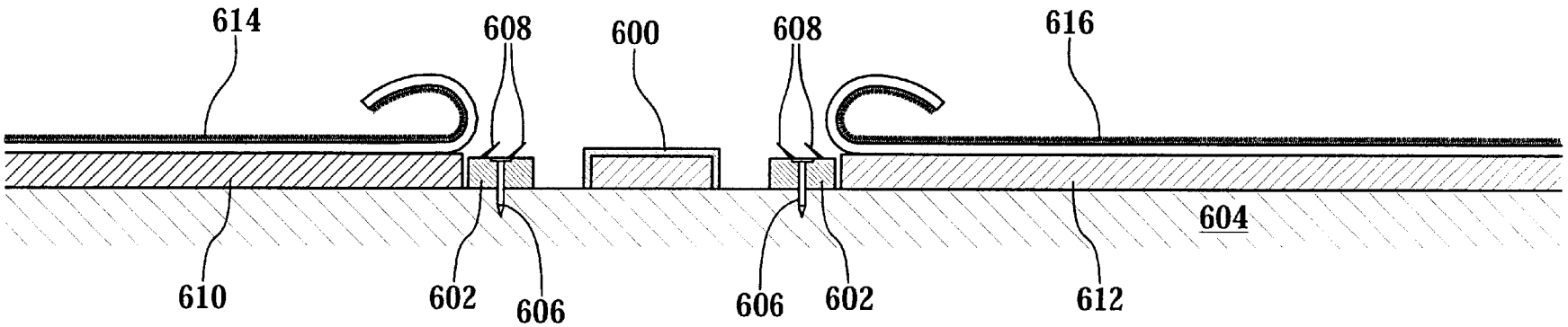
FIGS. 6A and 6B illustrate the installation process for a transition device in accordance with one embodiment of the present invention.
Figure 6B:
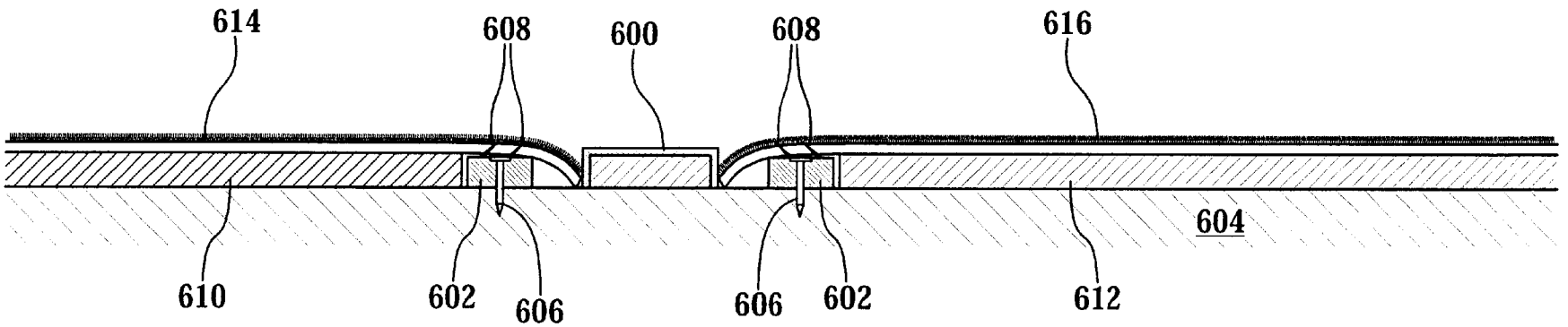

Now referring to FIGS. 6A and 6B, the installation process for a transition device 600 in accordance with one embodiment of the present invention is illustrated. In this particular example, the first and second floor coverings are carpet 614 and 616. In addition, this example is equally applicable to both doorway and non-doorway installations. The transition device 600 is attached to the floor 604 using glue and/or masonry nails, screws or other fasteners. Tack strips or tackless strips 602 are cut into lengths to fit each wall and the transition device 600. The strips 602 are then nailed to the floor 604 around the perimeter of the room using masonry nails 606 or other fastening device. The strips 602 should be spaced away from the wall and the transition device 600 by approximately ⅔ of the thickness of the carpet. Moreover, the strips 602 should join together at the corners and the pointed pins 608 in each strip should face the wall or transition device 600. The padding 610 and 612 are then cut to fit the rooms, attached to the floor 604 and trimmed so that the padding abuts the strips 602. The carpet 614 is then cut and laid on top of the padding 610. Likewise, carpet 616 is then cut and laid on top of the padding 612. The carpet 614 and 616 are then systematically hooked to the strips 602 and stretched until the edge of the carpet 614 and 616 is attached to the all the strips 602 around the room. Excess carpet 614 and 616 at each wall is then trimmed. The edges of the carpet 614 and 616 are pushed between the wall and the strips 602. Similarly, the edges of the carpet 614 and 616 are pushed between the transition device 600 and the strips 602.

The embodiments and examples set forth herein are presented to best explain the present invention and its practical application and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims.

What is claimed is:

1. A transition device assembly comprising:

an elongated core having a top, bottom, opposing sides and opposing ends;

a covering attached to the elongated core and tightly covering the surfaces of the top and opposing sides of the elongated core, wherein the elongated core is between a first floor covering and a second floor covering and the covering and elongated core have a combined height to provide a level surface with the first floor covering and the second floor covering.

2. The device as recited in claim 1, wherein the covering is decorative and wear-resistant.

3. The device as recited in claim 1, wherein the covering also covers portions of the bottom of the elongated core.

4. The device as recited in claim 1, wherein the elongated core is selected from a group of materials essentially consisting of pressboard, compressed fiberboard, wood, plywood, particleboard and metal.

5. The device as recited in claim 1, wherein the elongated core's cross section is substantially rectangular.

6. The device as recited in claim 1, wherein the elongated core's cross section is substantially trapezoidal.

7. The device as recited in claim 1, further comprising a notch in each end of the elongated core and covering to accommodate a doorstop.

8. The device as recited in claim 1, wherein the covering extends beyond the ends of the elongated core and further comprising a notch in each end of the extended covering to accommodate a doorstop.

9. The device as recited in claim 1, wherein the covering is selected from a group of materials essentially consisting of sheet vinyl, laminate and one or more vinyl pieces.

10. The device as recited in claim 1, wherein the covering is attached to the elongated core with glue.

11. The device as recited in claim 1, wherein the covering is attached to the elongated core with staples.

12. The device as recited in claim 1, wherein the first and second floor coverings are selected from a group of materials essentially consisting of carpet, tile, wood and vinyl.

13. A system comprising:

a transition device attached to a floor having an elongated core and a covering;

the elongated core having a top, a bottom, opposing sides and opposing ends;

a first floor covering attached to the floor and abutting one side of the transition device;

a second floor covering attached to the floor and abutting the other side of the transition device; and, a covering attached to the elongated core and tightly covering the surfaces of the top and opposing sides of the elongated core, the covering and the core having a combined height to provide a level surface with said first and second coverings.

14. The system as recited in claim 13, wherein the covering is decorative and wear-resistant.

15. The system as recited in claim 13, wherein the covering also covers portions of the bottom of the elongated core.

16. The system as recited in claim 13, wherein the elongated core is selected from a group of materials essentially consisting of pressboard, compressed fiberboard, wood, plywood, particleboard and metal.

17. The system as recited in claim 13, wherein the elongated core's cross section is substantially rectangular.

18. The system as recited in claim 13, wherein the elongated core's cross section is substantially trapezoidal.

19. The system as recited in claim 13, further comprising a notch in each end of the elongated core and covering to accommodate a doorstop.

20. The system as recited in claim 13, wherein the covering extends beyond the ends of the elongated core and further comprising a notch in each end of the extended covering to accommodate a doorstop.

21. The system as recited in claim 13, wherein the covering is selected from a group of materials essentially consisting of sheet vinyl, laminate and one or more vinyl pieces.

22. The system as recited in claim 13, wherein the covering is attached to the elongated core with glue.

23. The system as recited in claim 13, wherein the covering is attached to the elongated core with staples.

24. The system as recited in claim 13, wherein the first and second floor coverings are selected from a group of materials essentially consisting of carpet, tile, wood and vinyl.

25. The system as recited in claim 13, wherein the first and second floor coverings are carpet and further comprising a first pad disposed between the first floor covering and the floor and a second pad disposed between the second floor covering and the floor.

26. The system as recited in claim 13, wherein the first and second floor coverings are attached to the floor using strips.

27. A method for manufacturing a device for transitioning between a first floor covering and a second floor covering comprising the steps of:

fabricating an elongated core having a top, a bottom, opposing sides and opposing ends; and attaching a covering to the elongated core such that the covering tightly covers the surfaces of the top and opposing sides of the elongated core, the covering and the core having a combined height to provide a level surface with the first and second floor coverings.

28. The method as recited in claim 27, wherein the covering is decorative and wear-resistant.

29. The method as recited in claim 27, wherein the covering also covers portions of the bottom of the elongated core.

30. The method as recited in claim 27, wherein the elongated core is selected from a group of materials essentially consisting of pressboard, compressed fiberboard, wood, plywood, particleboard and metal.

31. The method as recited in claim 27, wherein the elongated core's cross section is substantially rectangular.

32. The method as recited in claim 27, wherein the elongated core's cross section is substantially trapezoidal.

33.The method as recited in claim 27, further comprising in each end of the elongated core and covering to accommodate a doorstop.

34. The method as recited in claim 27, wherein the covering extends beyond the ends of the elongated core and further comprising the step of cutting a notch in each end of the extended covering to accommodate a doorstop.

35. The method as recited in claim 27, wherein the covering is selected form a group of materials essentially consisting of sheet vinyl, laminate and one or more vinyl pieces.

36. The method as recited in claim 27, wherein the covering is attached to the elongated core with glue.

37. The method as recited in claim 27, wherein the covering is attached to the elongated core with staples.

38. A device for transitioning between a first floor covering and a second floor covering, the transition device comprising:

an elongated core having a top, a bottom, opposing sides and opposing ends;

a covering attached to the elongated core and covering the top and opposing sides of the elongated core; and a notch in each end of the elongated core and the covering to accommodate a doorstop.

39. A device for transitioning between a first floor covering and a second floor covering, the transition device comprising:

an elongated core having a top, a bottom, opposing sides and opposing ends; and a covering attached to the elongated core and covering the top and opposing sides of the elongated core, wherein the covering extends beyond the ends of the elongated core and further comprises a notch in each end of the extended covering to accommodate a doorstop.

40. A system comprising:

a transition device attached to a floor having an elongated core and a covering;

the elongated core having a top, a bottom, opposing sides and opposing ends;

the covering attached to the elongated core and covering the top and opposing sides of the elongated core;

a first floor covering attached to the floor and abutting one side of the transition device;

a second floor covering attached to the floor and abutting the other side of the transition device; and a notch in each end of the elongated core and covering to accommodate a doorstop.

41. A system comprising:

a transition device attached to a floor having an elongated core and a covering;

the elongated core having a top, a bottom, opposing sides and opposing ends;

the covering attached to the elongated core and covering the top and opposing sides of the elongated core, wherein the covering extends beyond the ends of the elongated core and further comprises a notch in each end of the extended covering to accommodate a doorstop;

a first floor covering attached to the floor and abutting one side of the transition device; and a second floor covering attached to the floor and abutting the other side of the transition device.

42. A method for manufacturing a device for transitioning between a first floor covering and a second floor covering comprising the steps of:

fabricating an elongated core having a top, a bottom, opposing sides and opposing ends; and attaching a covering to the elongated core such that the covering covers the top and opposing sides of the elongated core, wherein the covering extends beyond the ends of the elongated core and further comprising the step of cutting a notch in each end of the extended covering to accommodate a doorstop.

* * * * *